US009146578B2

(12) United States Patent
Shimada et al.

(10) Patent No.: US 9,146,578 B2
(45) Date of Patent: Sep. 29, 2015

(54) COATING APPARATUS, METHOD FOR PRODUCING ELECTROPHOTOGRAPHIC PHOTOSENSITIVE MEMBER AND METHOD FOR MASS-PRODUCING ELECTROPHOTOGRAPHIC PHOTOSENSITIVE MEMBERS

(75) Inventors: Akira Shimada, Suntou-gun (JP); Shoji Kawase, Nagahama (JP)

(73) Assignee: Canon Kabushiki Kaisha, Tokyo (JP)

( * ) Notice: Subject to any disclaimer, the term of this patent is extended or adjusted under 35 U.S.C. 154(b) by 974 days.

(21) Appl. No.: 13/207,748

(22) Filed: Aug. 11, 2011

(65) Prior Publication Data

US 2012/0045569 A1 Feb. 23, 2012

(30) Foreign Application Priority Data

Aug. 17, 2010 (JP) ..... 2010-182336
Jul. 20, 2011 (JP) ..... 2011-159350

(51) Int. Cl.

| | |
|---|---|
| ***B05C 11/10*** | (2006.01) |
| ***G05G 5/05*** | (2006.01) |
| ***B05C 3/09*** | (2006.01) |
| ***B05B 15/00*** | (2006.01) |
| ***B05C 3/109*** | (2006.01) |

(52) U.S. Cl.

CPC ..... *G05G 5/05* (2013.01); *B05B 15/008* (2013.01); *B05C 3/09* (2013.01); *B05C 3/109* (2013.01)

(58) Field of Classification Search

CPC ..... B05C 3/09; B05C 3/109; C25D 3/00; C25D 17/02; C25D 17/28; C05G 5/05

USPC ..... 118/600–612, 429; 204/257, 276

See application file for complete search history.

(56) References Cited

U.S. PATENT DOCUMENTS 4,000,056 A * 12/1976 Kelleher ..... 204/272
5,108,552 A * 4/1992 Desthomas ..... 205/82

FOREIGN PATENT DOCUMENTS

| | | | |
|---|---|---|---|
| JP | 59-177161 | A | 10/1984 |
| JP | 01-119365 | A | 5/1989 |
| JP | 07-132258 | A | 5/1995 |
| JP | 11-072932 | A | 3/1999 |
| JP | 2002-049162 | A | 2/2002 |
| JP | 2002-323778 | A | 11/2002 |
| JP | 2003-066634 | A | 3/2003 |
| JP | 2003-345041 | A | 12/2003 |
| JP | 2007-127922 | A | 5/2007 |

* cited by examiner

*Primary Examiner* — Laura Edwards

(74) *Attorney, Agent, or Firm* — Canon U.S.A., Inc. IP Division

(57) ABSTRACT

Provided is a coating apparatus that suppresses the phenomenon in which a semisolid film is retained on the upper-end edge portion of the coating bath even after the circulation of the coating liquid is resumed, resulting in the occurrence of coating defects, and a method for producing an electrophotographic photosensitive member using the coating apparatus. The upper-end portion of the coating bath includes a first upper-end surface, a second upper-end surface that is positioned below the first upper-end surface and has an outer diameter larger than that of the first upper-end surface, and a step surface that interconnects the first upper-end surface and the second upper-end surface. The coating liquid is capable of overflowing from the coating bath, flowing along the second upper-end surface, and flowing while wetting the whole area of the step surface when the circulation is resumed.

2 Claims, 8 Drawing Sheets

-- Prior Art --

-- Prior Art --

-- Prior Art --

-- Prior Art --

-- Prior Art --

COATING APPARATUS, METHOD FOR PRODUCING ELECTROPHOTOGRAPHIC PHOTOSENSITIVE MEMBER AND METHOD FOR MASS-PRODUCING ELECTROPHOTOGRAPHIC PHOTOSENSITIVE MEMBERS

BACKGROUND OF THE INVENTION

1. Field of the Invention

The present invention relates to a coating apparatus, a method for producing an electrophotographic photosensitive member using the coating apparatus, and a method for mass-producing electrophotographic photosensitive members.

2. Description of the Related Art

An electrophotographic photosensitive member typically has a support and a photosensitive layer formed on the support. Also, an electrically conductive layer, an under coat layer (intermediate layer), and the like may be provided between the support and the photosensitive layer, and a protective layer may be provided on the photosensitive layer.

For producing an electrophotographic photosensitive member, methods for forming a layer such as a photosensitive layer on a support include, for example, a dip coating method, a roll coater method, a spray method, an electrostatic coating method, and the like. Among these, the dip coating method may be advantageous where an object to be coated has a three-dimensional shape, such as a cylindrical shape, a seamless belt shape, or the like. In addition, the dip coating method is advantageous in mass production because a single coating apparatus (dip coating apparatus) is capable of simultaneously coating a plurality of objects. Thus, the dip coating method has been widely employed for the production (mass production) of electrophotographic photosensitive members.

FIG. 6 shows an example of a coating apparatus (dip coating apparatus).

In the coating apparatus shown in FIG. 6, a coating liquid 20 is sent to the lower portion of a coating bath 9 via a collection tank 2 and a filter 4 with the aid of a liquid transport unit 3 such as a pump or the like. Also, the coating liquid 20 in excess of the capacity of the coating bath 9 falls into an overflow vessel 10, and then is sent to the collection tank 2 via piping. The reference numeral 6 indicates the liquid surface of the coating liquid 20. Using the coating liquid circulator described above, the coating liquid 20 circulates within the coating apparatus. Also, a cover cap 7 that is provided with a through port 8 for the passage of an object to be coated 1 therethrough covers the coating bath 9. The cover cap 7 suppresses the entry of foreign substances into the coating liquid 20 and the solvent volatilization from the coating liquid 20. The object to be coated/coated object 1 is partially gripped by a lowering and lifting unit (not shown), is dipped into the coating liquid 20 contained in the coating bath 9, and then lifted up therefrom, whereby a coating film (wet coating film) is formed on the surface of the object to be coated 1. Also, a hood 5 prevents the coating film from being affected by the ambient conditions after being lifted out. The hood 5 is installed above the through port 8 of the cover cap 7.

During intervals of producing an electrophotographic photosensitive member or the like, the circulation of the coating liquid within the coating apparatus may be temporarily stopped in order to exchange a filter at regular intervals or maintain a lowering and lifting unit and a liquid transport unit. While the circulation of the coating liquid within the coating apparatus is stopped, a solvent is evaporated from the liquid surface of the coating liquid in the coating bath, resulting in an increase in the viscosity of the coating liquid. Consequently, a partially semi-solid film (hereinafter referred to as "semi-solid film") may be formed on the liquid surface of the coating liquid. When the circulation of the coating liquid is resumed, a semisolid film is caught by, and stays at, the upper-end edge portion of the coating bath, resulting in the retention thereof. A semisolid film remaining on the upper-end edge portion of the coating bath makes the flow of the coating liquid in the coating bath (the overflow of the coating liquid from the coating bath) non-uniform, whereby coating defects such as unevenness in film thickness or the like may occur.

As a method for suppressing the retention of foreign substances at the liquid surface of the coating liquid in the coating bath, Japanese Patent Laid-Open No. 2002-323778 discloses a method for providing a notch part or a stop part at the upper-end portion of the coating bath.

Also, as a method for maintaining a uniform overflow of the coating liquid from the coating bath, Japanese Patent Laid-Open No. 07-132258 discloses a coating bath in which a sloped surface 14, as shown in FIGS. 8A and 8B, sloping toward outside from a upper-end surface 12 is provided relative to the shape of the typical coating bath as shown in FIGS. 7A and 7B.

However, the method disclosed in Japanese Patent Laid-Open No. 2002-323778 is effective for air bubbles but substantially ineffective for semisolid films. Furthermore, the flow of the coating liquid near the notch part or the stop part becomes non-uniform, resulting in the occurrence of coating defects.

Also, the coating bath disclosed in Japanese Patent Laid-Open No. 07-132258 may reduce the risk of the retention of the semisolid film to some extent, but still is not sufficient for suppressing the retention of the semisolid film.

SUMMARY OF THE INVENTION

The present invention is directed to a coating apparatus that suppresses the phenomenon in which a semisolid film, which may be formed on the liquid surface of the coating liquid while the circulation of the coating liquid within the coating apparatus is paused, is retained on the upper-end edge portion of the coating bath even after the circulation of the coating liquid is resumed, and the retained semisolid film causes the occurrence of coating defects.

Further, the present invention is directed to a method for producing an electrophotographic photosensitive member using the aforementioned coating apparatus.

Further, the present invention is directed to a method for mass-producing electrophotographic photosensitive members using the aforementioned coating apparatus.

According to one aspect of the present invention, there is provided a coating apparatus that comprises: a cylindrical coating bath for containing a coating liquid; a lowering and lifting unit for dipping an object to be coated into the coating liquid in the coating bath and lifting it therefrom; and a circulator for circulating the coating liquid so that the coating liquid overflows beyond an upper end portion of the coating bath, wherein the upper-end portion of the coating bath comprises: a first upper-end surface; a second upper-end surface that is positioned below the first upper-end surface and has an outer diameter larger than that of the first upper-end surface; and a step surface that interconnects the first upper-end surface and the second upper-end surface, wherein the circulator is capable of pausing the circulation while keeping the coating bath being filled with the coating liquid without overflowing the coating liquid therefrom, and resuming the circulation, and wherein, when the circulation of the coating liquid is resumed after the pause of the circulation of the coating liquid, the overflowed coating liquid flows along the second upper-end surface while wetting the whole area of the step surface.

According to another aspect of the present invention, there is provided a method for producing an electrophotographic photosensitive member, comprising a step of forming a coating film on the surface of the object to be coated by a dip coating method, wherein the dip coating method is carried out using the aforementioned coating apparatus.

According to further aspect of the present invention, there is provided a method for mass-producing electrophotographic photosensitive members that comprises:

(i) providing a coating apparatus comprising:

a cylindrical coating bath for containing a coating liquid, a lowering and lifting unit for lowering and lifting an object to be coated for an electrophotographic photosensitive member, and a circulator for circulating the coating liquid, (ii) lowering an object to be coated for an electrophotographic photosensitive member, dipping it into the coating liquid, and then lifting it from the coating liquid, the coating liquid being circulated with the circulator so that the coating liquid overflows beyond an upper end portion of the coating bath, and (iii) repeating the step (ii) to produce a plurality of coated objects, wherein the upper-end portion of the coating bath comprises:

a first upper-end surface;

a second upper-end surface that is positioned below the first upper-end surface, and has an outer diameter larger than that of the first upper-end surface; and a step surface that interconnects the first upper-end surface and the second upper-end surface, and wherein the method further comprises:

(iv) pausing a circulation of the coating liquid while keeping the coating bath being filled with the coating liquid without overflowing the coating liquid therefrom; and (v) resuming the circulation so that the overflowed coating liquid flows along the second upper-end surface while wetting the whole area of the step surface.

According to the present invention, a coating apparatus that suppresses the phenomenon in which a semisolid film, which may be formed on the liquid surface of the coating liquid while the circulation of the coating liquid within the coating apparatus is stopped, is retained on the upper-end edge portion of the coating bath even after the circulation of the coating liquid is resumed, resulting in the occurrence of coating defects, may be provided.

Also, according to the present invention, a method for producing an electrophotographic photosensitive member using the aforementioned coating apparatus may be provided.

Also, according to the present invention, a method for mass-producing electrophotographic photosensitive members using the aforementioned coating apparatus may be provided.

Further features of the present invention will become apparent from the following description of exemplary embodiments with reference to the attached drawings.

DESCRIPTION OF THE EMBODIMENTS

The coating apparatus of the present disclosure is a coating apparatus that has functions at least to dip an object to be coated into a coating liquid in a coating bath and to lift the object to be coated therefrom, while circulating the coating liquid within the coating apparatus such that the coating liquid overflows from the coating bath beyond an upper-end portion thereof, to form a coating film on the surface of the object to be coated.

Figure 6:
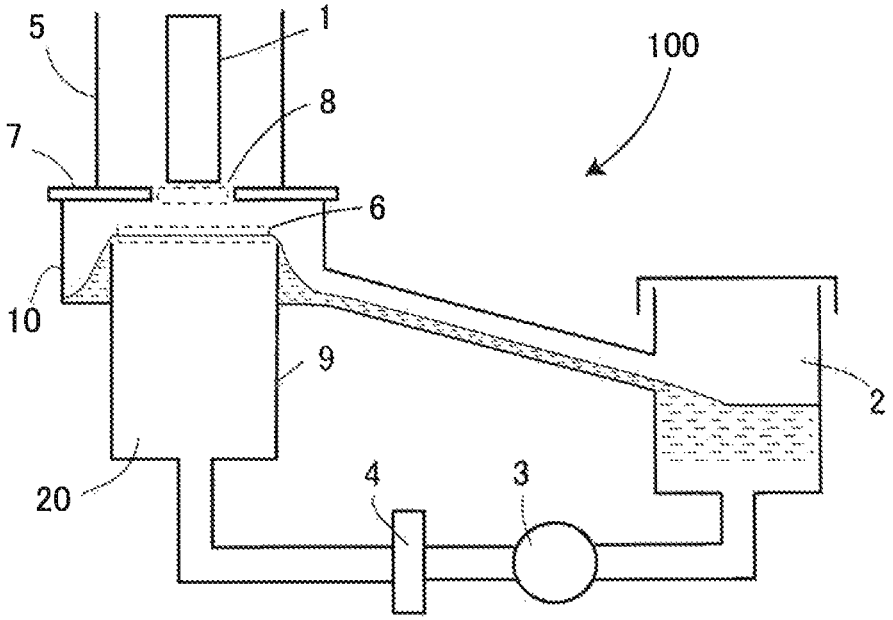
FIG. 6 is a view illustrating an example of a coating apparatus (dip coating apparatus).

An exemplary coating apparatus 100 of the present disclosure includes the coating apparatus 100 having the configuration shown in FIG. 6.

Figure 4:
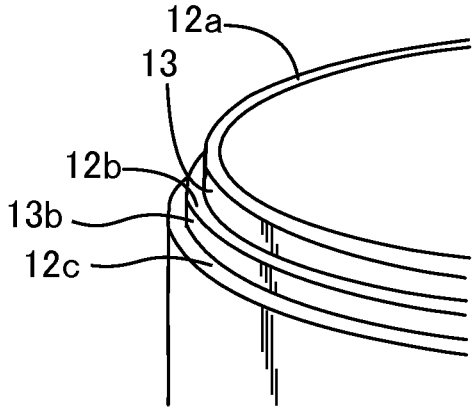
FIG. 4 is an enlarged view of the upper-end portion of an exemplary coating bath in the coating apparatus of the present invention.

In the coating apparatus 100 shown in FIG. 6, coating liquid 20 is sent to the lower portion of a coating bath 9 via a collection tank 2 and a filter 4 with the aid of a liquid transport unit 3 such as a pump or the like. In the case of the present disclosure, the shape of the coating bath 9 may be formed into a new and novel shape or arrangement as shown in FIG. 1 or FIG. 4.

The coating liquid 20 in excess of the capacity of the coating bath 9 falls into an overflow vessel 10, and then is sent to the collection tank 2 via piping. Using the coating liquid circulator described above, the coating liquid 20 circulates within the coating apparatus. Also, a cover cap 7 that is provided with a through port 8 for the passage therethrough of an object to be coated 1, covers over the coating bath 9. The cover cap 7 suppresses the entry of foreign substances into the coating liquid 20 and the solvent volatilization from the coating liquid 20. The object to be coated 1 may be partially gripped by a lowering and lifting unit (not shown), and is dipped into the coating liquid 20 contained in the coating bath 9, and then lifted out, whereby a coating film (wet coating film) is formed on the surface of the object to be coated 1. Also, a hood 5 that prevents the wet coating film from being affected by the ambient conditions, such as a surrounding wind, is installed above the through port 8 of the cover cap 7.

Figure 1A:
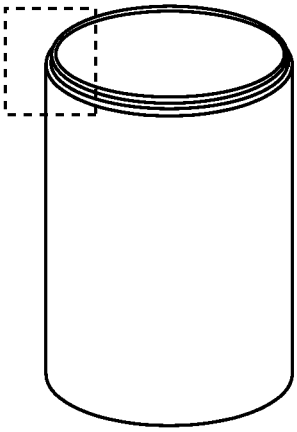
FIG. 1A is a view illustrating an example of a coating bath in the coating apparatus of the present invention.
Figure 1B:
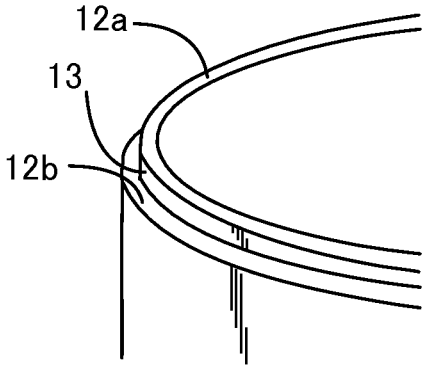
FIG. 1B is an enlarged view of the upper-end portion of the coating bath shown in FIG. 1A.

An exemplary shape of the coating bath for use in the coating apparatus 100 of the present invention, is shown in FIG. 1A and FIG. 1B. As shown in FIG. 1B, the upper-end portion of the coating bath shown in FIG. 1A includes a first upper-end surface 12*a*, a second upper-end surface 12*b* that is positioned below the first upper-end surface 12*a* and has an outer diameter larger than that of the first upper-end surface 12*a*, and a step surface 13 that interconnects the first upper-end surface 12*a* and the second upper-end surface 12*b*.

Figure 2A:
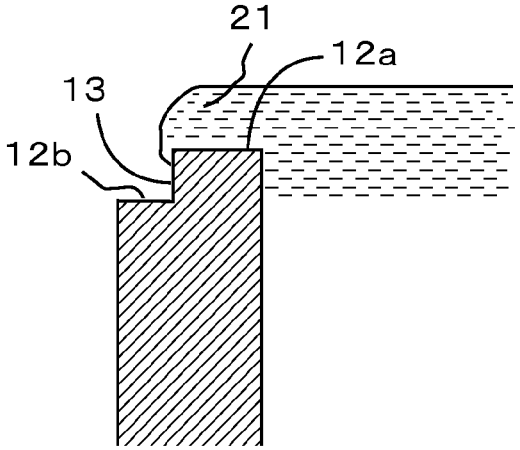
FIG. 2A is a vertical cross-sectional view of the upper-end portion of the coating bath in the coating apparatus of the present invention.
Figure 2B:
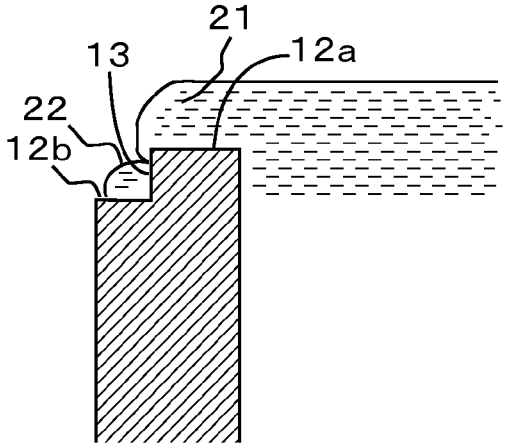
FIG. 2B is a vertical cross-sectional view of the upper-end portion of the coating bath in the coating apparatus of the present invention.

Each of FIG. 2A and FIG. 2B is a vertical cross-sectional view of the upper-end portion of the coating bath shown in FIG. 1. When the circulation of the coating liquid within the coating apparatus is stopped and thus the overflow of the coating liquid from the coating bath is stopped, the semisolid film 21 is formed on the liquid surface of the coating liquid after a lapse of a certain amount of time period. Then, the formed semisolid film 21 is caught by the first upper-end surface 12*a* (the upper-end edge portion), and thus may be retained on the first upper-end surface 12*a* (FIG. 2A). Then, the circulation of the coating liquid within the coating apparatus is resumed, the coating liquid overflows from the coating bath bypassing the semisolid film retained on the first upper-end surface 12*a*. A part of the coating liquid that has overflowed from the coating bath beyond the first upper-end surface 12*a* flows along the second upper-end surface 12*b* while wetting the whole area of the step surface 13. Then, the part of the coating liquid is stretched out below the semisolid film 21 and is in contact with the semisolid film 21, whereby the semisolid film 21 can be made to flow therebelow (FIG. 2B). The reference numeral 22 indicates the coating liquid that has flowed along the second upper-end surface 12*b* and stretched out below the semisolid film 21.

Figure 3A:
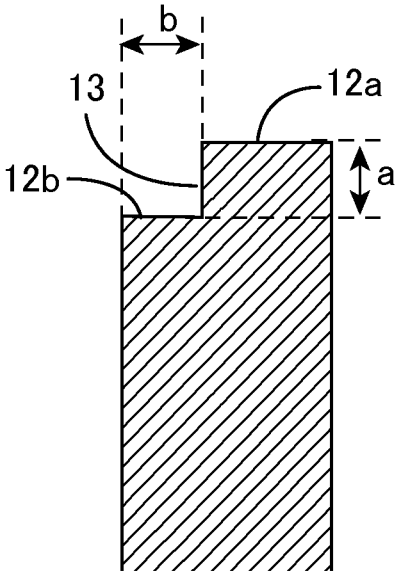
FIG. 3A is a vertical cross-sectional view of the upper-end portion of the coating bath in the coating apparatus of the present invention.
Figure 3B:
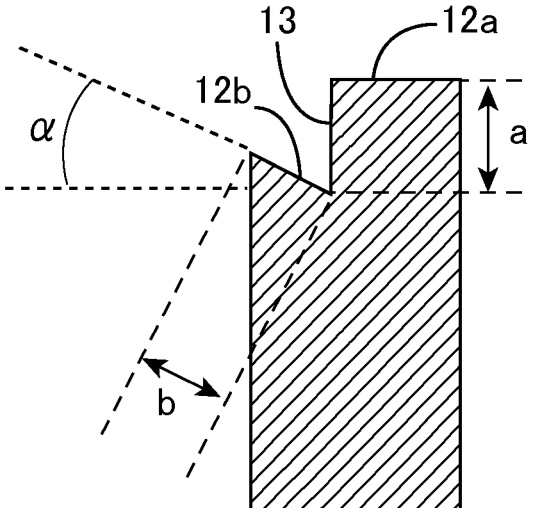
FIG. 3B is a vertical cross-sectional view of the upper-end portion of the coating bath in the coating apparatus of the present invention.

As shown in FIG. 3B, it is preferable that the second upper-end surface 12*b* has a slope such that the outer circumferential portion thereof is higher than the inner circumferential portion thereof. With this arrangement, the coating liquid that has overflowed from the coating bath can be more reliably stretched out below the semisolid film. The angle between the second upper-end surface 12*b* and the horizontal direction (a in FIG. 3B) is preferably in a range from 0 degree to 30 degree. At a larger angle $\alpha$, the coating liquid tends to be stretched out below the semisolid film, whereas at a smaller angle $\alpha$, the semisolid film tends to flow below. When the second upper-end surface 12*b* has a slope such that the outer circumferential portion thereof is lower than the inner circumferential portion thereof, the value of angle $\alpha$ is considered to be negative in value, relative to a horizontal line (i.e. below the horizontal line).

Also, the length in the vertical direction of the step surface 13 (the symbol "a" shown in FIG. 3A and FIG. 3B) is preferably in a range from 0.5 mm to 3 mm. At a larger length "a", the semisolid film tends not to extend astride the first upper-end surface 12*a* and the second upper-end surface 12*b* and thus is hardly caught thereby, whereby the coating liquid flowed along the second upper-end surface 12*b* is readily stretched out below the semisolid film. At a shorter length "a", the coating liquid that flows along the second upper-end surface 12*b* readily wets the whole area of the step surface 13, and thus, the coating liquid is readily in contact with the semisolid film.

The shortest distance between the inner circumferential portion and the outer circumferential portion of the second upper-end surface 12*b* (the symbol "b" shown in FIG. 3A and FIG. 3B) is preferably in a range from 0.3 mm to 3 mm. At a longer distance "b", the coating liquid is readily stretched out below the semisolid film. At a shorter distance "b", the semisolid film is at least caught by the second upper-end surface 12*b*, and thus the coating liquid that has flowed along the second upper-end surface 12*b* is readily stretched out below the semisolid film.

In the present invention, it is preferable that the upper-end surface of the upper-end portion of the coating bath has only two surfaces consisting of the first upper-end surface and the second upper-end surface. Even when a third or subsequent upper-end surface positioned below the second upper-end surface is provided (for example, FIG. 4), it is less likely that the semisolid film will be caught by the second upper-end surface or the third or subsequent upper-end surface in comparison with the first upper-end surface, and thus, the third or subsequent upper-end surface has almost no opportunity for contributing the downward flow of the semisolid film. Also, when the third or subsequent upper-end surface is provided, it may be more likely that the semisolid film that has flowed down from the first upper-end surface is caught by the third or subsequent upper-end surface.

Preferably, the angle $\alpha$, the length "a", and the distance "b" shown in FIG. 3 have a relationship in which, when the circulation of the coating liquid within the coating apparatus is resumed after the circulation of the coating liquid within the coating apparatus has been stopped for a period of time, the coating liquid may be capable of overflowing from the coating bath, flowing along the second upper-end surface, and flowing while wetting the whole area of the step surface 13.

Next, a description will be given of a method for producing an electrophotographic photosensitive member using the coating apparatus of the present invention.

In general, an electrophotographic photosensitive member is produced by forming a photosensitive layer on a support. The photosensitive layer may be a single layer-type photosensitive layer containing a charge transport material and a charge generation material that are contained in the same layer, or may be a laminate type (functional separation type) photosensitive layer in which the functions are separated in a charge transport layer containing a charge transport material and a charge generation layer containing a charge generation material. The photosensitive layer is preferably a laminate type photosensitive layer in view of electrophotographic characteristics. Among the laminate types, a type (normal order layer type) in which a charge generation layer and a charge transport layer are laminated in this order from the support side is preferable. An electrically conductive layer and an under coat layer described herein may be provided between the support and the photosensitive layer, and a protective layer described below may be provided on the photosensitive layer.

The aforementioned "coating film" may be an electrically conductive layer, an under coat layer, a photosensitive layer (charge generation layer or charge transport layer), a protective layer, or another layer. The aforementioned "object to be coated" means the object for which the "coating film" is to be formed on the surface thereof. For example, when an electrophotographic photosensitive member includes a support, an electrically conductive layer, an under coat layer, a charge generation layer, a charge transport layer, and a protective layer disposed on the support and in this order, the terms "coating film" and "object to be coated" are defined as follows.

When the "coating film" is an electrically conductive layer, the "object to be coated" is a support.

When the "coating film" is an under coat layer, the "object to be coated" is an object having a support and an electrically conductive layer on the support.

When the "coating film" is a charge generation layer, the "object to be coated" is an object having a support, and, an electrically conductive layer and an under coat layer formed in this order on the support.

When the "coating film" is a charge transport layer, the "object to be coated" is an object having a support, and, an electrically conductive layer, an under coat layer and a charge generation layer formed in this order on the support.

When the "coating film" is a protective layer, the "object to be coated" is an object having a support, and, an electrically conductive layer, an under coat layer, a charge generation layer and a charge transport layer formed in this order on the support.

The coating apparatus of the present invention is applicable to any one of the layers described above, or is also applicable to a plurality of layers. A semisolid film tends to be formed on a coating liquid having the viscosity of particularly 30 to 800 mPa·s. A coating liquid for a charge transport layer is typically adjusted to have the viscosity in the range of 30 mPa·s to 800 mPa·s. At a lower viscosity, sagging or drooping of the coating liquid can occur, and thus, the film thickness of a coating film to be formed on the surface of the axially upper portion of the object to be coated tends to be thinner than that of a coating film to be formed on the surface of the axially central portion or the axially lower portion of the object to be coated. Also, at a higher viscosity, the leveling when coating becomes insufficient, and thus unevenness in the coating film tends to occur. In particular, for the coating liquid having the viscosity of 500 mPa·s or lower, the coating apparatus of the present invention is effective with regard to suppressing the retention of the semisolid film. Here, the viscosity is a value measured using a single cylindrical-type rotating viscometer (trade name: Bismetron VS-A1 type) made by Shibaura System Co., Ltd., when the temperature of the coating liquid is 25° C.

Also, the coating apparatus of the present invention is employed for the circulation of the coating liquid such that the coating liquid level rises in the coating bath to overflow from the coating bath. The rising rate of the coating liquid level, when the coating liquid level rises in the coating bath, is typically adjusted to be within the range of 30 mm/min to 280 mm/min. At a slower rising rate, unevenness in the coating film hardly occurs, whereas at a faster rising rate, the coating liquid is less susceptible to stagnation in the coating bath. Under a condition in which the coating liquid level rises in the coating bath at the rising rate of particularly 60 mm/min or larger, the coating apparatus of the present invention is effective in suppressing the retention of the semisolid film.

Hereinafter, a detailed description will be given with respect to an example of an electrophotographic photosensitive member having a laminate type photosensitive layer.

It is preferable that the support is the one having electrical conductivity (electrically conductive support). For example, a metallic (alloy) support made of, for example, aluminum, aluminum alloy, copper, zinc, stainless steel, vanadium, molybdenum, chromium, titanium, nickel, indium, gold, platinum, and the like may be employed. Also, a metallic support or a plastic support having a metal (alloy) coating (those described above) formed by a vacuum evaporation method may also be employed. The plastic may include polyethylene, polypropylene, polyvinyl chloride, polyethylene terephthalate, acrylic resin, and the like.

A support formed by impregnating a plastic or paper with electrically conductive particles such as carbon black, tin oxide particles, titanium oxide particles, silver particles, and the like together with a binder resin, a plastic support having an electrically conductive binder resin, and the like may also be employed.

Examples of the shape of the support includes a cylindrical shape, a seamless belt shape (i.e. an endless belt shape), and the like. Among these, a cylindrical shape is preferred.

For the purpose of suppressing interference fringes due to scattering of a laser beam, the surface of a support may be subjected to a cutting treatment, a surface roughening treatment, an alumite treatment, or the like.

For the purpose of suppressing interference fringes due to scattering of a laser beam or coating scratches on a support, an electrically conductive layer may be provided between a support and a photosensitive layer (a charge generation layer, a charge transport layer) or an under coat layer to be described below.

An electrically conductive layer can be formed in a manner such that a coating liquid for an electrically conductive layer is coated, and the obtained coating film is dried and/or cured. The coating liquid for an electrically conductive layer has been obtained by subjecting the dispersion treatment to electrically conductive particles such as carbon black, metal particles, metallic oxide particles, and the like together with a binder resin and a solvent.

The film thickness of an electrically conductive layer preferably ranges from 1 μm to 40 μm, and more preferably ranges from 2 μm to 20 μm.

Also, an under coat layer having a barrier function and a bonding function may be provided between a support or an electrically conductive layer and a photosensitive layer (a charge generation layer, a charge transport layer). An under coat layer is provided for the purpose of improving adhesiveness and coat-ability of a photosensitive layer, improving charge injection properties from a support, improving protection against the electric rupture of a photosensitive layer, and the like.

An under coat layer can be formed in a manner such that a coating liquid for an under coat layer, which has been obtained by dissolving a resin in a solvent, is coated, and the obtained coating film is dried.

Examples of a resin for use in an under coat layer include acrylic resins, allyl resins, alkyd resins, ethylcellulose resins, ethylene-acrylic acid copolymer, epoxy resins, casein resins, silicone resins, gelatin resins, phenolic resins, butyral resins, polyacrylates, polyacetal, polyamideimide, polyamide, polyallyl ether, polyimide, polyurethane, polyester, polyethylene, polycarbonate, polystyrene, polysulfone, polyvinyl alcohol, polybutadiene, polypropylene, urea resins, and the like.

Also, an under coat layer may be formed using aluminum oxide or the like.

Further, metal particles, alloy particles, metallic oxide particles, salts, surfactants, or the like may also be added to an under coat layer as necessary.

The film thickness of an under coat layer is preferably in a range from 0.05 μm to 7 μm, and more preferably in a range from 0.1 μm to 2 μm.

A charge generation layer can be formed in a manner such that a coating liquid for a charge generation layer is coated, and the obtained coating film is dried and/or cured. The coating liquid for a charge generation layer has been obtained by subjecting the dispersion treatment to a charge generation material together with a binder resin and a solvent. Examples of a drying and curing method include heating, radiation irradiation, and the like. Examples of a dispersion processing method include a method using, for example, a homogenizer, an ultrasound dispenser, a ball mill, a sand mill, a roll mill, a vibrating mill, an attritor, a liquid collision-type high-speed dispenser, and the like.

Examples of the charge generation material include azo pigments such as monoazo-type, disazo-type, or trisazo-type; metallo- or nonmetallo-phthalocyanine pigments; indigo pigments such as indigo or thioindigo; perylene pigments such as perylene acid anhydride or perylene acid imide; polycyclic quinone pigments such as anthraquinone and pyrenequinone; squarium dyes; pyrylium salts or thiopyrylium salts; triphenylmethane dyes; inorganic materials such as selenium, selenium-tellurium or amorphous silicon; quinacridone pigments, azlenium salt pigments, cyanine dyes; xanthene dyes, quinoneimine dyes, styryl dyes; cadmium sulfide; zinc oxide, and the like. These charge generation materials may be used alone or in combination.

Examples of the binder resin for use in the charge generation layer include acrylic resin, allyl resins, alkyd resins, epoxy resins, diallyl phthalate resins, silicone resins, styrene-butadiene copolymer, phenolic resins, butyral resins, benzal resins, polyacrylates, polyacetal, polyamideimide, polyamide, polyallyl ether, polyallylate, polyimide, polyurethane, polyester, polyethylene, polycarbonate, polystyrene, polysulfone, polyvinyl acetal, polybutadiene, polypropylene, methacrylic resins, urea resins, vinyl chloride-vinyl acetate copolymer, vinyl acetate resins, and the like. Among these, butyral resins or the like are preferred. These may be used alone or as a mixture or copolymer of two or more.

The ratio of the binder resin in the charge generation layer is preferably 90% by mass or less and more preferably 50% by mass or less relative to the total mass of the charge generation layer.

Examples of the solvent for use in the coating liquid for a charge generation layer include organic solvents such as alcohol, sulfoxide, ketone, ether, ester, aliphatic halogen hydrocarbons, aromatic compounds, and the like.

The film thickness of the charge generation layer is preferably in a range from 0.001 μm to 6 μm, and more preferably in a range from 0.01 μm to 1 μm.

Also, a sensitizer, an antioxidant, an ultraviolet absorbent, a plasticizer, or the like may be added to the charge generation layer as necessary.

A charge transport layer can be formed in a manner such that a coating liquid for a charge transport layer, which has been obtained by dissolving a charge transport material and a binder resin in a solvent, is coated, and the obtained coating film is dried and/or cured. Examples of a drying and curing method include heating, radiation irradiation, and the like.

Examples of the charge transport material include triarylamine compounds, hydrazone compounds, styryl compounds, stilbene compounds, pyrazoline compounds, oxazole compounds, thiazole compounds, triarylmethane compounds, and the like. These charge transport material may be used alone or in combination.

Examples of the binder resin for use in the charge transport layer include acrylic resins, acrylonitrile resins, allyl resins, alkyd resins, epoxy resins, silicone resins, phenolic resins, phenoxy resins, butyral resins, polyacrylamide, polyacetal, polyamideimide, polyamide, polyallyl ether, polyallylate, polyimide, polyurethane, polyester, polyethylene, polycarbonate, polystyrene, polysulfone, polyvinyl butyral, polyphenyleneoxide, polybutadiene, polypropylene, methacrylic resins, urea resins, vinyl chloride resins, vinyl acetate resins, and the like. Among these, polyallylate or polycarbonate is preferred. These may be used alone or as a mixture or copolymer of two or more.

The ratio of the charge transport material in the charge transport layer is preferably in a range from 20% to 80% by mass, and more preferably in a range from 30% to 70% by mass relative to the total mass of the charge transport layer.

The ratio of the charge transport material and the binder resin is preferably in the range from 5:1 to 1:5 (mass ratio).

Examples of the coating liquid for a charge transport layer include organic solvents such as monochlorobenzene, dioxane, toluene, xylene, N-methylpyrrolidone, dichloromethane, tetrahydrofuran, methylal, and the like.

Also, an antioxidant, an ultraviolet absorbent, a plasticizer, or the like may be added to the charge transport layer as necessary.

A protective layer may be provided on a photosensitive layer for the purpose of protecting it. A protective layer can be formed in a manner such that a coating liquid for a protective layer, which has been obtained by dissolving various binder resins described above in a solvent, is coated, and the obtained coating film is dried and/or cured. Examples of a drying and curing method include heating, radiation irradiation, and the like.

A layer acting as the surface layer of an electrophotographic photosensitive member may contain a lubricant. Examples of such lubricant include polymer, monomer, and oligomer, and the like including silicon atoms or fluorine atoms. Specific examples of the lubricant include N-(n-propyl)-N-(β-acryloxyethyl)-perfluorooctyl sulfonic acid amide, N-(n-propyl)-(β-methacryloxyethyl)-perfluorooctyl sulfonic acid amide, perfluorooctanesulfonic acid, perfluorocaprylic acid, N-n-propyl-n-perfluorooctanesulfonate amide-ethanol, 3-(2-perfluorohexyl)ethoxy-1,2-dihydroxypropane, N-n-propyl-N-2,3-dihydroxypropylperfluoroo-tylsulfonamide, and the like. Further examples of the lubricant include fluorine atom-containing resin particles such as polytetrafluoroethylene, polychlorotrifluoroethylene, polyvinylidene fluoride, polydichlorodifluoroethylene, tetrafluoroethylene-perfluoroalkylvinylether copolymer, tetrafluoroethylene-hexafluoropropylene copolymer, tetrafluoroethylene-ethylene copolymer, tetrafluoroethylene-hexafluoropropylene-perfluoroalkylvinylether copolymer, and the like. These lubricants may be used alone or in combination. When the lubricant is made of a resin, the number-average molecular weight thereof is preferably in a range from 3,000 to 5,000,000, and more preferably in a range from 10,000 to 3,000,000. When the lubricant is made of particles, the average particle diameter thereof is preferably in a range from 0.01 μm to 10 μm, and more preferably in a range from 0.05 μm to 2.0 μm.

A resistance adjustor may be added to the surface layer of an electrophotographic photosensitive member as necessary. Examples of such resistance adjustor include particles such as $SnO_2$, ITO, carbon black, silver, or the like. The resistance adjustor subjected to hydrophobic processing may also be employed. The resistance of the surface layer to which the resistance adjustor has been added is preferably in the range from $10^9$ Ω·cm to $10^{14}$ Ω·cm.

When a protective layer is provided, the protective layer is the surface layer of an electrophotographic photosensitive member. When the protective layer is not provided and the photosensitive layer is a normal order layer type photosensitive layer, the charge transport layer is the surface layer of an electrophotographic photosensitive member. When the protective layer is not provided and the photosensitive layer is a reverse layered-type photosensitive layer, the charge generation layer is the surface layer of an electrophotographic photosensitive member.

Figure 5:
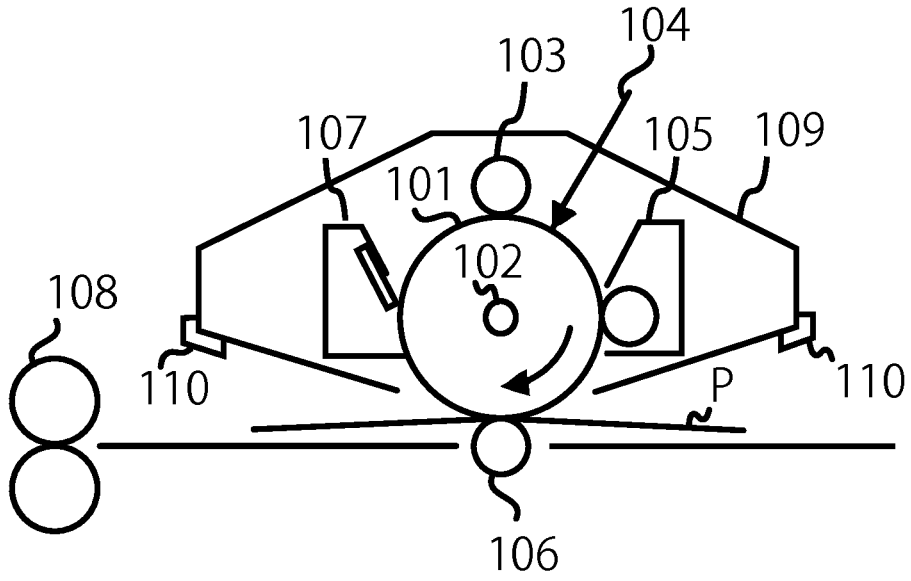
FIG. 5 is a schematic configuration view illustrating an example of an electrophotographic apparatus provided with a process cartridge having an electrophotographic photosensitive member produced by using the coating apparatus of the present invention.

FIG. 5 is a schematic configuration view illustrating an example of an electrophotographic apparatus provided with a process cartridge having an electrophotographic photosensitive member produced by the coating apparatus of the present invention.

In FIG. 5, a cylindrical electrophotographic photosensitive member 101 is rotationally driven about an axis 102 at a prescribed peripheral speed in the direction of the arrow.

The surface of the electrophotographic photosensitive member 101 to be rotationally driven is uniformly charged by means of a charging unit (primary charging unit: charging roller or the like) 103 to have a prescribed positive or negative potential. Next, exposure light (image exposure light) 104, which has been output from an exposure unit (not shown) such as slit exposure, laser beam scanning exposure, or the like, is irradiated onto the surface of the electrophotographic photosensitive member 101. Consequently, an electrostatic latent image corresponding to the target image is successively formed on the surface of the electrophotographic photosensitive member 101.

The electrostatic latent image formed on the surface of the electrophotographic photosensitive member 101 is developed by a toner contained in the developer of the development unit 105 to thereby form a toner image. Next, the toner image formed on the surface of the electrophotographic photosensitive member 101 is transferred to a transfer material (e.g., paper) P by means of a transfer unit (e.g., transfer roller) 106. Then, the transfer material (e.g., paper) P is taken and fed out from a transfer material supplying unit (not shown) to a position (contact portion) between the electrophotographic photosensitive member 101 and the transfer unit 106 in synchronism with the rotation of the electrophotographic photosensitive member 101.

The transfer material P with the toner image thereon is separated from the surface of the electrophotographic photosensitive member 101, and is conveyed to a fixing unit 108 for image fixing to thereby be printed out the transfer material P as an image-formed material (print, copy) outside the electrophotographic apparatus.

Residual developer particles on the surface of the electrophotographic photosensitive member 101 after the transfer (residual toner particles after transfer) are removed by a cleaning unit (e.g., cleaning blade) 107 to provide a cleaned surface. Furthermore, the surface of the electrophotographic photosensitive member 101 is subjected to discharge processing by the irradiation of pre-exposure light (not shown) from a pre-exposure unit (not shown), and is employed for image formation in a repeated manner. As shown in FIG. 5, when a charging unit 103 is a contact charging unit employing a charging roller or the like, pre-exposure is not necessarily required.

Among the components selected from the electrophotographic photosensitive member 101, the charging unit 103, the development unit 105, the transfer unit 106, the cleaning unit 107, and the like, the plurality of components may be contained in a vessel and be integrally disposed as a process cartridge such that the process cartridge can be detachably mountable into the main body of an electrophotographic apparatus such as a copier, a laser beam printer, or the like. In FIG. 5, the electrophotographic photosensitive member 101, the charging unit 103, the development unit 105, and the cleaning unit 107 are integrally supported as a process cartridge 109 such that the process cartridge 109 can be detachably mountable into the main body of the electrophotographic apparatus using a guide unit 110 such as the rail or the like of the main body of the electrophotographic apparatus.

Hereinbelow, the present invention will be explained more specifically with reference to examples. However, the present invention is not limited thereto. In the following examples, "part(s)" means "mass part(s)".

Example 1-1

A mixture of 5,000 parts of the compound represented by the following structural formula (1) (charge transport material), (1)

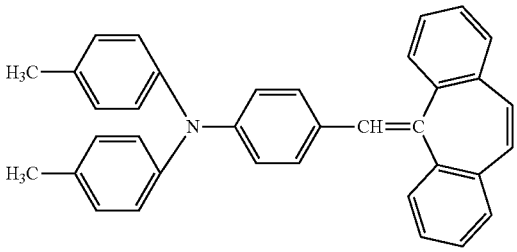

and 7,000 parts of a bisphenol Z-type polycarbonate (binder resin) (trade name: Iupilon Z-200, manufactured by Mitsubishi Engineering-Plastics Corporation, viscosity-average molecular weight (Mv): 20,000) was dissolved into a mixed solvent (25,000 parts of monochlorobenzene/12,000 parts of dimethoxymethane (methylal)) to prepare a coating liquid for a charge transport layer, the coating liquid having the viscosity of 150 mPa·s.

In the coating apparatus having the configuration shown in FIG. 6 and including 64 (8 rows and 8 columns) coating baths, each of the 64 coating baths having the shape shown in FIG. 1 and the values of a, b, and α shown in Table 1, the aforementioned coating liquid for a charge transport layer was circulated for 10 minutes, and then the circulation of the coating liquid was stopped. After 30 minutes from the time that the circulation is stopped, the circulation of the coating liquid for a charge transport layer was resumed, and after 5 minutes, the uniformity of the overflow of the coating liquid for a charge transport layer in each of the 64 coating baths was visually checked, and the number of the coating baths in which the overflow state of the coating liquid for a charge transport layer was defective due to the retention of the semi-solid film on the upper-end edge portion of the coating bath, was counted. The rising rate of the coating liquid for a charge transport layer while overflowing from the coating bath, was adjusted to 130 mm/min. These operations were repeated in ten times, and the number of the coating baths in which the overflow state of the coating liquid for a charge transport layer was defective, was counted for each operation. After repeating the operations ten times, the value, which is obtained by dividing the total number (defect quantity) of the coating baths in which the overflow state was defective by 640 (64×10 times), was multiplied by 100 to determine the defect rate [%]. The values of defect quantity and defect rate are shown in Table 1.

Examples 1-2 to 1-22

The operations performed in Examples 1-2 to 1-22 were the same as those performed in Example 1-1 except that the types and the amounts of the material for the coating liquid for a charge transport layer, the viscosity of the coating liquid for a charge transport layer, the rising rates of the coating liquid for a charge transport layer while overflowing from the coating bath, and the kinds of 64 coating baths (the values of a, b, α for the coating bath having the shape shown in FIG. 1) were set as shown in Table 1, and the values of defect quantity and defect rate were calculated. The values of defect quantity and defect rate are shown in Table 1.

The term "formula (1)" shown in Table 1 means the compound represented by the structural formula (1) described above. The term "PC" means a bisphenol Z-type polycarbonate (trade name: Iupilon Z-200, manufactured by Mitsubishi Engineering-Plastics Corporation, viscosity-average molecular weight (Mv): 20,000). The term "PA" means a bisphenol C-type polyallylate (weight-average molecular weight (Mw): 180,000). The term "MCB" means monochlorobenzene. The term "DMM" means dimethoxymethane. The term "OXY" means o-xylene.

Example 1-23

The operations performed in Example 1-23 were the same as those performed in Example 1-1 except that the coating bath with the shape shown in FIG. 4 was employed for 64 coating baths, and the values of defect quantity and defect rate were calculated. The values of defect quantity and defect rate are shown in Table 1. The angle between the second upper-end surface 12*b* and the horizontal direction and the angle between the third upper-end surface 12*c* and the horizontal direction were set to be 0 degree. Both of the length in the vertical direction of the step surface 13 and the length in the vertical direction of the step surface 13*b* were set to be 1.2 mm. Both of the shortest distance between the inner circumferential portion and the outer circumferential portion of the second upper-end surface 12*b* and the shortest distance between the inner circumferential portion and the outer circumferential portion of the third upper-end surface 12*c* were set to be 0.7 mm.

Comparative Example 1-1

Figure 7A:
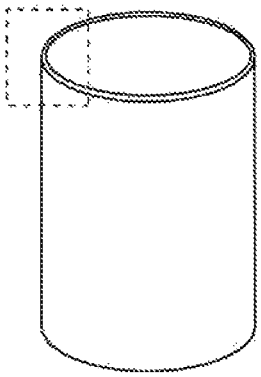
FIG. 7A is a view illustrating an example of the shape of a conventional typical coating bath.
Figure 7B:
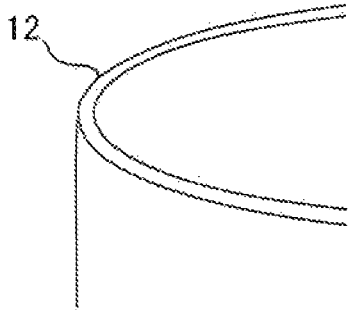
FIG. 7B is an enlarged view of the upper-end portion of the coating bath shown in FIG. 7A.

The operations performed in Comparative Example 1-1 were the same as those performed in Example 1-1 except that the coating bath with the shape shown in FIG. 7 was employed for 64 coating baths, and the values of defect quantity and defect rate were calculated. The values of defect quantity and defect rate are shown in Table 1.

Comparative Example 1-2

Figure 8A:
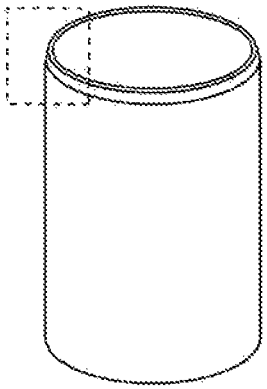
FIG. 8A is a view illustrating an example of the shape of a conventional coating bath.
Figure 8B:
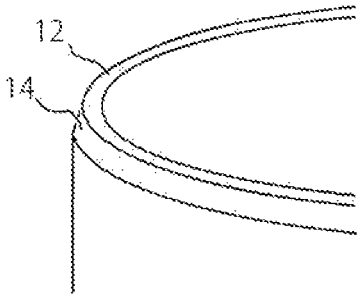
FIG. 8B is an enlarged view of the upper-end portion of the coating bath shown in FIG. 8A.

The operations performed in Comparative Example 1-2 were the same as those performed in Example 1-1 except that the coating bath with the shape shown in FIG. 8 was employed for 64 coating baths, and the values of defect quantity and defect rate were calculated. The values of defect quantity and defect rate are shown in Table 1.

TABLE 1

| | COATING LIQUID FOR CHARGE-TRANSPORT LAYER | | | | | | | | | | |
|---|---|---|---|---|---|---|---|---|---|---|---|
| | KIND AND AMOUNT OF MATERIAL OF COATING LIQUID FOR CHARGE TRANSPORT LAYER | | | | | | | | | | |
| | CHARGE TRANSPORT MATERIAL | BINDER RESIN | SOLVENT | VISCOSITY [mPa · s] | RISING RATE [mm/min] | COATING VESSEL SHAPE | α [°] | a [mm] | b [mm] | DEFECT QUANTITY | DEFECT RATE [%] |
| EXAMPLE 1-1 | FORMULA (1) 5000 PARTS | PC: 7000 PARTS | MCB: 25000 PARTS DMM: 12000 PARTS | 150 | 130 | FIG. 1 | 0 | 1.2 | 0.7 | 2 | 0.3 |
| EXAMPLE 1-2 | FORMULA (1) 5000 PARTS | PC: 7000 PARTS | MCB: 25000 PARTS DMM: 12000 PARTS | 150 | 130 | FIG. 1 | 10 | 1.2 | 0.7 | 1 | 0.2 |
| EXAMPLE 1-3 | FORMULA (1) 5000 PARTS | PC: 7000 PARTS | MCB: 25000 PARTS DMM: 12000 PARTS | 150 | 130 | FIG. 1 | 0 | 0.5 | 0.7 | 3 | 0.5 |
| EXAMPLE 1-4 | FORMULA (1) 5000 PARTS | PC: 7000 PARTS | MCB: 25000 PARTS DMM: 12000 PARTS | 150 | 130 | FIG. 1 | 0 | 0.4 | 0.7 | 7 | 1.1 |
| EXAMPLE 1-5 | FORMULA (1) 5000 PARTS | PC: 7000 PARTS | MCB: 25000 PARTS DMM: 12000 PARTS | 150 | 130 | FIG. 1 | 0 | 2.5 | 0.7 | 3 | 0.5 |
| EXAMPLE 1-6 | FORMULA (1) 5000 PARTS | PC: 7000 PARTS | MCB: 25000 PARTS DMM: 12000 PARTS | 150 | 130 | FIG. 1 | 0 | 2.7 | 0.7 | 8 | 1.3 |
| EXAMPLE 1-7 | FORMULA (1) 5000 PARTS | PC: 7000 PARTS | MCB: 25000 PARTS DMM: 12000 PARTS | 150 | 130 | FIG. 1 | 30 | 1.2 | 0.7 | 2 | 0.3 |
| EXAMPLE 1-8 | FORMULA (1) 5000 PARTS | PC: 7000 PARTS | MCB: 25000 PARTS DMM: 12000 PARTS | 150 | 130 | FIG. 1 | 40 | 1.2 | 0.7 | 6 | 0.9 |
| EXAMPLE 1-9 | FORMULA (1) 5000 PARTS | PC: 7000 PARTS | MCB: 25000 PARTS DMM: 12000 PARTS | 150 | 130 | FIG. 1 | −10 | 1.2 | 0.7 | 7 | 1.1 |
| EXAMPLE 1-10 | FORMULA (1) 5000 PARTS | PC: 7000 PARTS | MCB: 25000 PARTS DMM: 12000 PARTS | 150 | 130 | FIG. 1 | 0 | 1.2 | 0.3 | 4 | 0.6 |
| EXAMPLE 1-11 | FORMULA (1) 5000 PARTS | PC: 7000 PARTS | MCB: 25000 PARTS DMM: 12000 PARTS | 150 | 130 | FIG. 1 | 0 | 1.2 | 0.2 | 8 | 1.3 |
| EXAMPLE 1-12 | FORMULA (1) 5000 PARTS | PC: 7000 PARTS | MCB: 25000 PARTS DMM: 12000 PARTS | 150 | 130 | FIG. 1 | 0 | 1.2 | 3 | 3 | 0.5 |
| EXAMPLE 1-13 | FORMULA (1) 5000 PARTS | PC: 7000 PARTS | MCB: 25000 PARTS DMM: 12000 PARTS | 150 | 130 | FIG. 1 | 0 | 1.2 | 4 | 6 | 0.9 |
| EXAMPLE 1-14 | FORMULA (1) 5000 PARTS | PC: 7000 PARTS | OXY: 25000 PARTS DMM: 12000 PARTS | 130 | 130 | FIG. 1 | 0 | 1.2 | 0.7 | 2 | 0.3 |
| EXAMPLE 1-15 | FORMULA (1) 5000 PARTS | PC: 7000 PARTS | MCB: 40000 PARTS DMM: 17000 PARTS | 30 | 130 | FIG. 1 | 0 | 1.2 | 0.7 | 1 | 0.2 |
| EXAMPLE 1-16 | FORMULA (1) 5000 PARTS | PC: 7000 PARTS | MCB: 45000 PARTS DMM: 18000 PARTS | 20 | 130 | FIG. 1 | 0 | 1.2 | 0.7 | 0 | 0.0 |
| EXAMPLE 1-17 | FORMULA (1) 6000 PARTS | PA: 6000 PARTS | MCB: 42000 PARTS DMM: 27000 PARTS | 500 | 130 | FIG. 1 | 0 | 1.2 | 0.7 | 4 | 0.6 |

TABLE 1-continued

| | COATING LIQUID FOR CHARGE-TRANSPORT LAYER | | | | | | | | | | |
|---|---|---|---|---|---|---|---|---|---|---|---|
| | KIND AND AMOUNT OF MATERIAL OF COATING LIQUID FOR CHARGE TRANSPORT LAYER | | | | | | | | | | |
| | CHARGE TRANSPORT MATERIAL | BINDER RESIN | SOLVENT | VISCOSITY [mPa · s] | RISING RATE [mm/min] | COATING VESSEL SHAPE | α [°] | a [mm] | b [mm] | DEFECT QUANTITY | DEFECT RATE [%] |
| EXAMPLE 1-18 | FORMULA (1) 6000 PARTS | PA: 6000 PARTS | MCB: 40000 PARTS DMM: 22000 PARTS | 580 | 130 | FIG. 1 | 0 | 1.2 | 0.7 | 8 | 1.3 |
| EXAMPLE 1-19 | FORMULA (1) 5000 PARTS | PC: 7000 PARTS | MCB: 25000 PARTS DMM: 12000 PARTS | 150 | 60 | FIG. 1 | 0 | 1.2 | 0.7 | 4 | 0.6 |
| EXAMPLE 1-20 | FORMULA (1) 5000 PARTS | PC: 7000 PARTS | MCB: 25000 PARTS DMM: 12000 PARTS | 150 | 50 | FIG. 1 | 0 | 1.2 | 0.7 | 7 | 1.1 |
| EXAMPLE 1-21 | FORMULA (1) 5000 PARTS | PC: 7000 PARTS | MCB: 25000 PARTS DMM: 12000 PARTS | 150 | 280 | FIG. 1 | 0 | 1.2 | 0.7 | 2 | 0.3 |
| EXAMPLE 1-22 | FORMULA (1) 5000 PARTS | PC: 7000 PARTS | MCB: 25000 PARTS DMM: 12000 PARTS | 150 | 300 | FIG. 1 | 0 | 1.2 | 0.7 | 2 | 0.3 |
| EXAMPLE 1-23 | FORMULA (1) 5000 PARTS | PC: 7000 PARTS | MCB: 25000 PARTS DMM: 12000 PARTS | 150 | 130 | FIG. 4 | | | | 7 | 1.1 |
| COMPARATIVE EXAMPLE 1-1 | FORMULA (1) 5000 PARTS | PC: 7000 PARTS | MCB: 25000 PARTS DMM: 12000 PARTS | 150 | 130 | FIG. 7 | | | | 42 | 6.6 |
| COMPARATIVE EXAMPLE 1-2 | FORMULA (1) 5000 PARTS | PC: 7000 PARTS | MCB: 25000 PARTS DMM: 12000 PARTS | 150 | 130 | FIG. 8 | | | | 33 | 5.2 |

Example 2-1

An electrophotographic photosensitive member was produced by using the coating apparatus of the present invention in the manner described below.

Firstly, an aluminum cylinder having the diameter of 30 mm and the length of 254 mm was employed as a support.

Next, 10 parts of polyamide (trade name: M-4000, manufactured by Toray Industries, Inc.) were dissolved into a mixed solvent (100 parts of methanol/90 parts of isopropanol) to prepare a coating liquid for an under coat layer. The coating liquid for an under coat layer was dip-coated on the support, and the obtained coating film was dried at 90° C. for 10 minutes, whereby an under coat layer having the film thickness of 0.6 μm was formed.

Next, 9 parts of hydroxy-gallium phthalocyanine crystal (charge generation material) having strong peaks at the positions of 7.4°±0.2° and 28.1°±0.2° of Bragg angle 2θ in the X-ray diffraction with CuKα radiation, 3 parts of polyvinyl butyral (trade name: S-LEC BX-1, manufactured by Sekisui Chemical Co. Ltd.), and 100 parts of tetrahydrofuran were placed in a sand mill using glass beads having the diameter of 1 mm, and subjected to dispersion treatment for 3 hours. The obtained dispersion was diluted by adding 200 parts of butyl acetate to prepare a coating liquid for a charge generation layer. The coating liquid for a charge generation layer was dip-coated on the under coat layer, and the obtained coating film was dried at 80° C. for 15 minutes, whereby a charge generation layer having the film thickness of 0.15 μm was formed.

As described above, 640 objects each having a support, and an under coat layer and a charge generation layer, disposed in the order described, on the support (hereinafter referred to simply as "object to be coated"), were produced.

Next, 640 objects to be coated are divided into 10 sets each including 64 objects. For each set, the coating liquid for a charge transport layer is dip-coated on the charge generation layer of the object to be coated using the same coating apparatus and the same coating liquid for a charge transport layer as those employed in Example 1-1, and dried at 120° C. for 60 minutes to thereby form a charge transport layer. Consequently, an electrophotographic photosensitive member of which the surface layer is the charge transport layer, was obtained. The rising rate of the coating liquid for a charge transport layer while overflowing from the coating bath was the same as that employed in Example 1-1.

The specific processing procedure of the dip coating is as follows. Firstly, in the same coating apparatus as that employed in Example 1-1, the same coating liquid for a charge transport layer as that employed in Example 1-1 was circulated for 10 minutes. Then, the coating liquid for a charge transport layer was dip-coated on the charge generation layers of the first-set objects to be coated. After the dip coating, the circulation of the coating liquid for a charge transport layer in the coating apparatus was stopped. After 30 minutes from the time that the circulation is stopped, the circulation of the coating liquid for a charge transport layer was resumed, and after 5 minutes, the coating liquid for a charge transport layer was dip-coated on the charge generation layers of the second-set objects to be coated. In this manner, the stop (stop for 30 minutes) and the resumption of the circulation of the coating liquid for a charge transport layer in the coating apparatus was repeated until the dip coating of the coating liquid for a charge transport layer was carried out for the tenth-set of objects to be coated.

The unevenness in film thickness of the charge transport layers of 640 electrophotographic photosensitive members obtained as described above, was visually checked for evaluation. More specifically, the film thickness of the central portion (position of 127 mm away from the upper-end portion in the axial direction (dip coating direction) of the object to be coated) of the charge transport layer was measured at 8 locations in the circumferential direction thereof in increments of 45 degrees. When the difference between the maximum value and the minimum value of the film thickness at eight locations was equal to or larger than 1.5 μm, such an electrophotographic photosensitive member was determined to be a defective electrophotographic photosensitive member in which unevenness in film thickness of the charge transport layer was large due to the retention of the semisolid film. The value, which is obtained by dividing the number (defect quantity) of the defective electrophotographic photosensitive members in which unevenness in film thickness of the charge transport layers is large by 640, was multiplied by 100 to determine the defect rate [%]. The values of defect quantity and defect rate are shown in Table 2. It should be noted that the value of the film thickness of the charge transport layer was measured by observing the cross-section of the electrophotographic photosensitive member using a microscope.

Examples 2-2 to 2-23 and Comparative Examples 2-1 and 2-2

Electrophotographic photosensitive members were produced by performing the same operations performed in Examples 2-2 to 2-23 and Comparative Examples 2-1 and 2-2 as those performed in Example 2-1 except that the coating apparatuses, the coating liquids for a charge transport layer, and the rising rates of the coating liquids for a charge transport layer while overflowing from the coating bath were set as shown in Table 2, and the values of defect quantity and defect rate were calculated. The values of defect quantity and defect rate are shown in Table 2.

TABLE 2

| | COATING APPARATUS | COATING LIQUID FOR CHARGE TRANSPORT LAYER | RISING RATE OF COATING LIQUID FOR CHARGE TRANSPORT LAYER | DEFECT QUANTITY | DEFECT RATE [%] |
|---|---|---|---|---|---|
| EXAMPLE 2-1 | | AS IN EXAMPLE 1-1 | | 2 | 0.3 |
| EXAMPLE 2-2 | | AS IN EXAMPLE 1-2 | | 1 | 0.2 |
| EXAMPLE 2-3 | | AS IN EXAMPLE 1-3 | | 3 | 0.5 |
| EXAMPLE 2-4 | | AS IN EXAMPLE 1-4 | | 6 | 0.9 |
| EXAMPLE 2-5 | | AS IN EXAMPLE 1-5 | | 3 | 0.5 |
| EXAMPLE 2-6 | | AS IN EXAMPLE 1-6 | | 7 | 1.1 |
| EXAMPLE 2-7 | | AS IN EXAMPLE 1-7 | | 2 | 0.3 |
| EXAMPLE 2-8 | | AS IN EXAMPLE 1-8 | | 6 | 0.9 |
| EXAMPLE 2-9 | | AS IN EXAMPLE 1-9 | | 7 | 1.1 |
| EXAMPLE 2-10 | | AS IN EXAMPLE 1-10 | | 4 | 0.6 |
| EXAMPLE 2-11 | | AS IN EXAMPLE 1-11 | | 7 | 1.1 |
| EXAMPLE 2-12 | | AS IN EXAMPLE 1-12 | | 2 | 0.3 |
| EXAMPLE 2-13 | | AS IN EXAMPLE 1-13 | | 6 | 0.9 |
| EXAMPLE 2-14 | | AS IN EXAMPLE 1-14 | | 2 | 0.3 |
| EXAMPLE 2-15 | | AS IN EXAMPLE 1-15 | | 1 | 0.2 |
| EXAMPLE 2-16 | | AS IN EXAMPLE 1-16 | | 0 | 0.0 |
| EXAMPLE 2-17 | | AS IN EXAMPLE 1-17 | | 4 | 0.6 |
| EXAMPLE 2-18 | | AS IN EXAMPLE 1-18 | | 8 | 1.3 |
| EXAMPLE 2-19 | | AS IN EXAMPLE 1-19 | | 4 | 0.6 |
| EXAMPLE 2-20 | | AS IN EXAMPLE 1-20 | | 7 | 1.1 |
| EXAMPLE 2-21 | | AS IN EXAMPLE 1-21 | | 2 | 0.3 |
| EXAMPLE 2-22 | | AS IN EXAMPLE 1-22 | | 2 | 0.3 |
| EXAMPLE 2-23 | | AS IN EXAMPLE 1-23 | | 7 | 1.1 |
| COMPARATIVE EXAMPLE 2-1 | | AS IN COMPARATIVE EXAMPLE 1-1 | | 38 | 5.9 |
| COMPARATIVE EXAMPLE 2-2 | | AS IN COMPARATIVE EXAMPLE 1-2 | | 30 | 4.7 |

When the results shown in Table 1 are compared with the results shown in Table 2, it is found that there is an approximate positive correlation between the retention of the semisolid film and the occurrence of unevenness in film thickness, and the occurrence of unevenness in film thickness is suppressed by suppressing the retention of the semisolid film.

While the present invention has been described with reference to exemplary embodiments, it is to be understood that the invention is not limited to the disclosed exemplary embodiments. The scope of the following claims is to be accorded the broadest interpretation so as to encompass all such modifications, equivalent structures and functions.

This application claims the benefit of Japanese Patent Applications No. 2010-182336, filed Aug. 17, 2010, and No. 2011-159350, filed Jul. 20, 2011 which are hereby incorporated by reference herein their entirety.

What is claimed is:

1. A coating apparatus comprising:

a cylindrical coating bath for containing a coating liquid;

a lowering and lifting unit for dipping an object to be coated into the coating liquid in the coating bath and lifting it therefrom; and a circulator for circulating the coating liquid so that the coating liquid overflows beyond an upper end portion of the coating bath, wherein the upper-end portion of the coating bath comprises:

a first upper-end surface;

a second upper-end surface that is positioned below the first upper-end surface and has an outer diameter larger than that of the first upper-end surface; and a step surface that interconnects the first upper-end surface and the second upper-end surface, wherein an angle between the second upper-end surface and the horizontal direction is in a range from 0 degree to 30 degrees, the length "a" in the vertical direction of the step surface is in a range from 0.5 mm to 2.5 mm, and the shortest distance between an inner circumferential portion of the second upper-end surface and an outer circumferential portion of the second upper-end surface "b" is in a range from 0.3 mm to 3 mm, wherein the circulator is capable of pausing the circulation while keeping the coating bath being filled with the coating liquid without overflowing the coating liquid therefrom, and resuming the circulation, and wherein, when the circulation of the coating liquid is resumed after the pause of the circulation of the coating liquid, the overflowed coating liquid flows along the second upper-end surface while wetting the whole area of the step surface.

2. The coating apparatus according to claim 1, wherein the second upper-end surface has a slope such that the outer circumferential portion thereof is higher than the inner circumferential portion thereof.

* * * * *